US006708784B1

(12) United States Patent
Borg

(10) Patent No.: US 6,708,784 B1
(45) Date of Patent: Mar. 23, 2004

(54) CORE BARREL VALVE ASSEMBLY

(75) Inventor: Thomas Borg, Stocksund (SE)

(73) Assignee: Atlas Copco Craelius AB, Marsta (SE)

( * ) Notice: Subject to any disclaimer, the term of this patent is extended or adjusted under 35 U.S.C. 154(b) by 0 days.

(21) Appl. No.: 10/069,206

(22) PCT Filed: Aug. 24, 2000

(86) PCT No.: PCT/SE00/01631

§ 371 (c)(1),
(2), (4) Date: Feb. 21, 2002

(87) PCT Pub. No.: WO01/14690

PCT Pub. Date: Mar. 1, 2001

(30) Foreign Application Priority Data

Aug. 24, 1999 (SE) ..... 9903019

(51) Int. Cl.[7] ..... E21B 25/00

(52) U.S. Cl. ..... 175/58; 175/247; 175/249; 175/244

(58) Field of Search ..... 175/246, 247, 175/236, 249, 244, 58; 294/86.26, 86.28, 86.29

(56) References Cited

U.S. PATENT DOCUMENTS 4,800,969 A 1/1989 Thompson
4,832,138 A 5/1989 Hallez
4,834,198 A * 5/1989 Thompson ..... 175/244
5,799,742 A 9/1998 Soinski et al.

* cited by examiner

*Primary Examiner*—David Bagnell
*Assistant Examiner*—Matthew J Smith
(74) *Attorney, Agent, or Firm*—Barnes & Thornburg

(57) ABSTRACT

The present invention relates to a method for a valve, which valve comprises a movable valve body (6) having a first side (9) facing a means for supplying pressurized fluid and influenced in the supply direction by a force from said fluid, and a second side (11) influenced in opposite direction by a force from said fluid, which valve is provided with at least one connection (8) connecting the first side (9) of the valve body with the second side (11) of the valve body, and also comprising a spring (20) for opening the valve by displacing the valve body from a closed position to an open position, said method comprising the following steps: a pressurized fluid is supplied to the valve in closed position so that the valve remains closed; the supply of pressurised fluid to the closed valve ceases, a force equalization then occurs between said first (9) and second (11) sides thereby enabling the spring to open the valve, and a pressurized fluid is supplied to the valve in open position and the valve remains open. The invention also relates to a valve for performing the method and to a system for wire line core drilling including such a valve.

22 Claims, 5 Drawing Sheets

CORE BARREL VALVE ASSEMBLY

CROSS-REFERENCE TO RELATED APPLICATIONS

Figure 1:
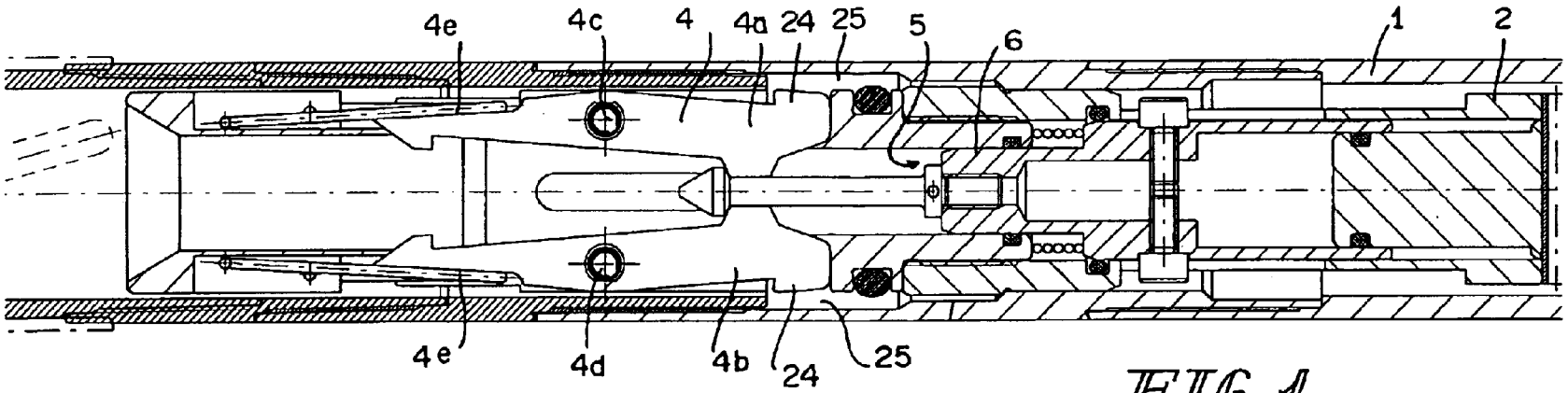

This application is a U.S. national counterpart application of international application serial No. PCT/SE00/01631 filed Aug. 24, 2000, which claims priority to Swedish application serial no. 9903019-9 filed Aug. 24, 1999.

The present invention relates to a method for a valve, a valve and a wire line core drilling system including such a valve.

It is known in various connections to use valves that control the supply of a fluid by being opened when they are subjected to a certain pressure from the fluid. One such application is in wire line core drilling, as will be described below.

When performing exploratory drilling to collect rock samples from depths of from several hundred to a couple of thousand meters, double core tubes are used having an inner and an outer tube. The sample is collected in the inner tube, which usually has a length of a few meters. When the inner tube is full this is usually detected by means of a manometer or the like that measures the flushing water pressure in the core tube. A retriever device suspended on a wire is lowered into the tube for retracting the inner tube with the sample, said retriever device comprising a gripping means in the form of a claw or "spearhead" arranged to engage with a gripping means arranged on/in the upper end of the inner tube. When the wire is then tautened the inner tube is disengaged from the outer tube, and the inner tube with the sample can be hoisted up. Conversely, the claw and the gripping means on the inner tube can be used to lower a new inner tube. Equipment of this type is generally known as a wire line system.

When a new inner tube is inserted it is important to be able to ascertain that the inner tube really has reached right down to the bottom of the outer tube and has assumed its correct position for drilling, before drilling is commenced. Ascertainment that the tube can no longer move, but is firmly held is generally taken as an indication that the inner tube has reached its correct position. According to known technology, therefore, the gripping means is often designed to be combined with some type of locking member that firmly locks the inner tube in relation to the outer tube when the inner tube has reached the correct position. This locking member usually consists of a hook-like device, preferably spring-loaded, a locking claw or latch that engages with recesses or shoulders arranged in the inside of the outer tube. Actual insertion of the inner tube is usually performed by the inner tube being "pumped" along inside the drill string with the aid of water. When the inner tube is firmly in place the water pressure will increase to such an extent that a valve arranged for flushing medium in the inner tube is released.

One problem with such known arrangements is that when the inner tube is inserted into the drill string it sometimes catches before it has reached the correct position for drilling. With designs currently in use, the increase in water pressure then occurring will release the flushing valve before the inner tube has reached its correct position and, in the worst case, drilling will be commenced. This primarily entails a disadvantage from the financial point of view since the drilling will be into thin air. There is also a risk of the core at the bottom being destroyed.

The primary object of the present invention is to remedy the problems described above.

The object of the invention is achieved by means of a method as defined in claim 1, a valve as defined in claim 5, and a wire line core drilling system as defined in claim 9.

In accordance with the present invention, therefore, a method is defined for a valve, which valve comprises a movable valve body having a first side facing a means for supplying pressurised fluid and influenced in the supply direction by a force from said fluid, and a second side influenced in opposite direction by a force from said fluid, which valve is provided with at least one connection connecting the first side of the valve body with the second side of the valve body, and also comprising a spring for opening the valve by displacing the valve body from a closed position to an open position, said method comprising the following steps:

- a pressurised fluid is supplied to the valve in closed position whereupon the valve remains closed,
- the supply of pressurised fluid to the closed valve ceases,
- a force equalisation then occurs between said first and second sides in that fluid flows through the connection, thereby enabling the spring to open the valve, and
- a pressurised fluid is supplied to the valve in open position and the valve remains open.

The present invention thus offers the advantage that the valve is not opened immediately an increase in pressure is obtained, but opening is delayed. This is particularly advantageous, for instance, when the valve is being used in conjunction with a wire line core drill.

The valve is advantageously provided with a locking device to mechanically lock the valve when it is in closed position, and the method then comprises the following favourable features:

- the pressurised fluid is supplied to the valve in closed and mechanically locked position,
- the locking device is caused to cease locking said valve in closed position,
- the valve continues to be closed even when the locking device no longer locks the valve, since the pressurised fluid supplied still causes the valve to remain closed,
- the supply of pressurised fluid ceases, and
- a force equalisation then occurs between said first and second sides, thereby enabling the spring to open the valve.

The features defined above offer the advantage of double security, since the valve not only has delay function, but is also mechanically locked in closed position.

The method is performed using a valve as defined in claim 5.

In accordance with the particularly advantageous application of the invention in wire line core drilling, the advantages are obtained that the flush valve is not released until the inner tube has assumed the correct position inside the outer tube for drilling and that when the valve is released, this occurs mechanically with the aid of the locking device in accordance with the invention. It is thus not released as a result of an increase in pressure, and the risks associated with previously known pressure-released arrangements are therefore eliminated. There is therefore no risk of drilling being commenced before the inner tube is safely in place. The completion of all steps in the method may also be used with advantage as an indication that the inner tube has assumed the correct position in the outer tube and that drilling may be commenced. For this purpose a signal may be conveyed to a drill rig. This is particularly advantageous with modern, computer-controlled drill rigs. A system for wire line core drilling provided with a valve in accordance with the invention, thus advantageously includes means for transmitting a signal to a drill rig, which signal indicates that the inner tube has assumed the correct position inside the outer tube, that the valve has been opened and that drilling can be commenced.

Additional features and advantages are revealed in the subordinate claims.

Figure 2:
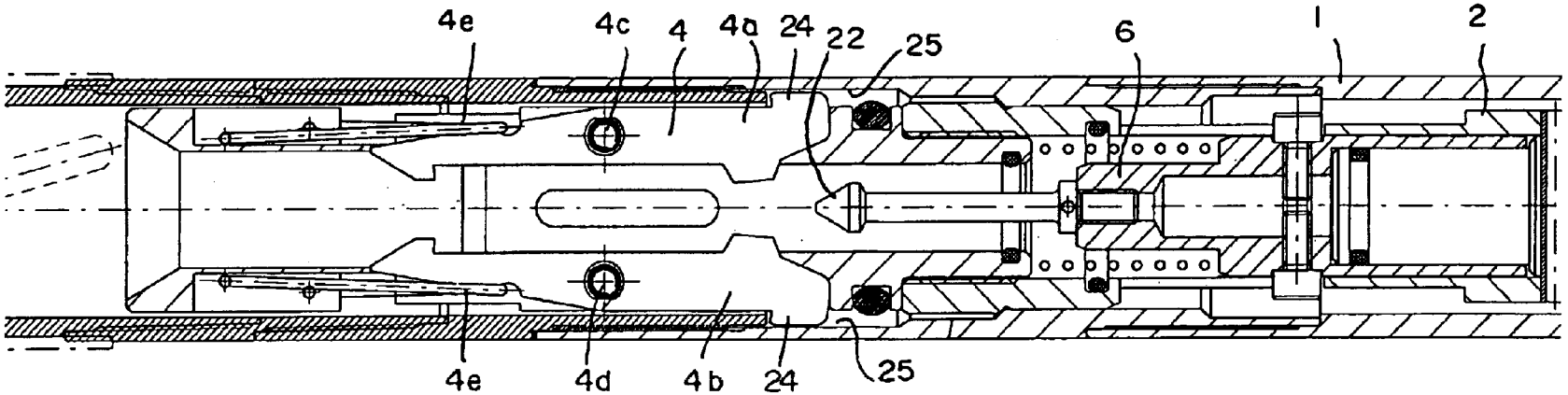
Figure 3:
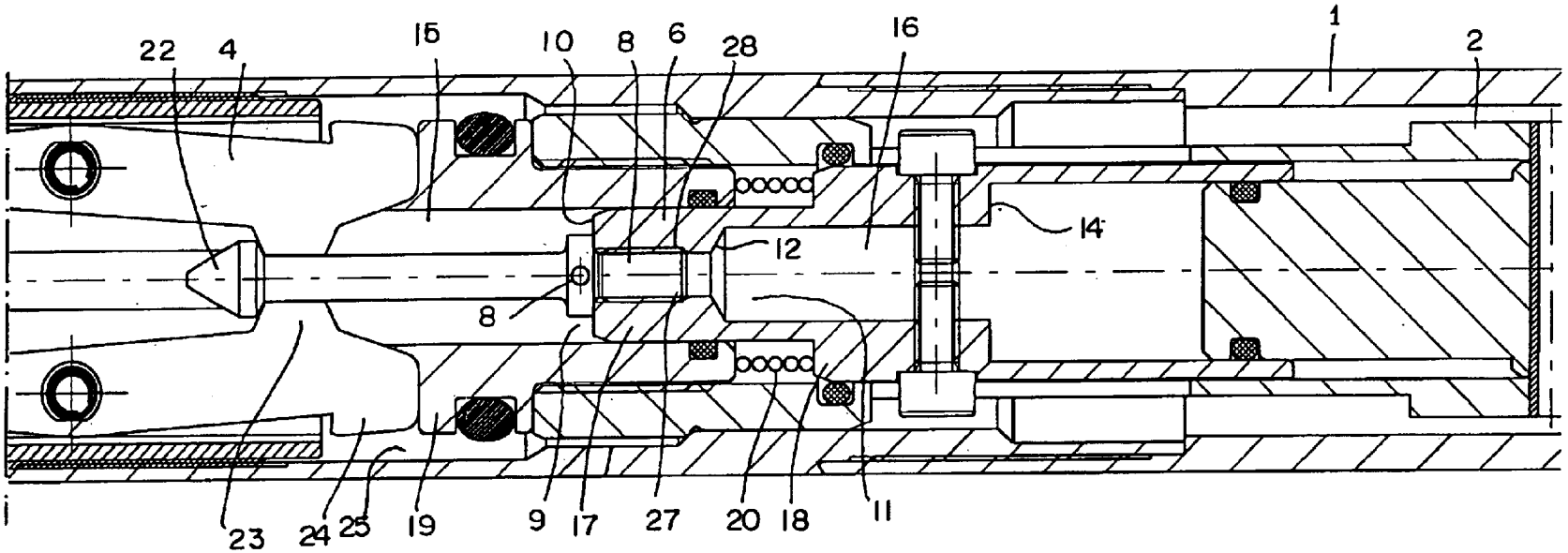
Figure 4:
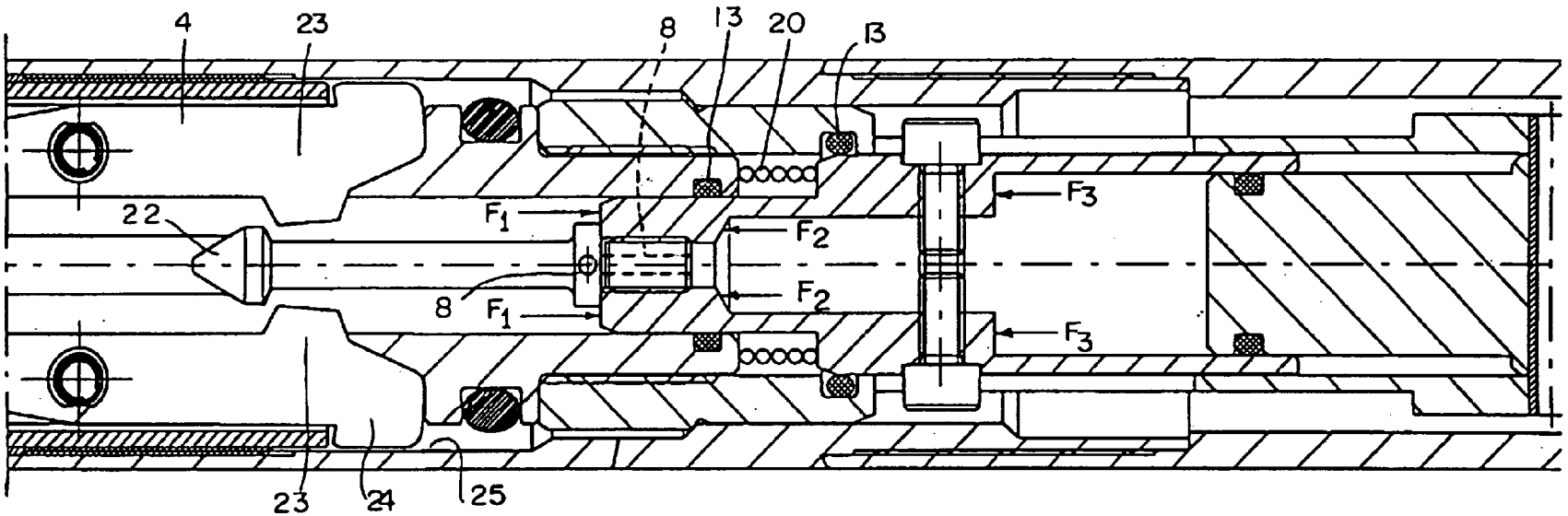
Figure 5:
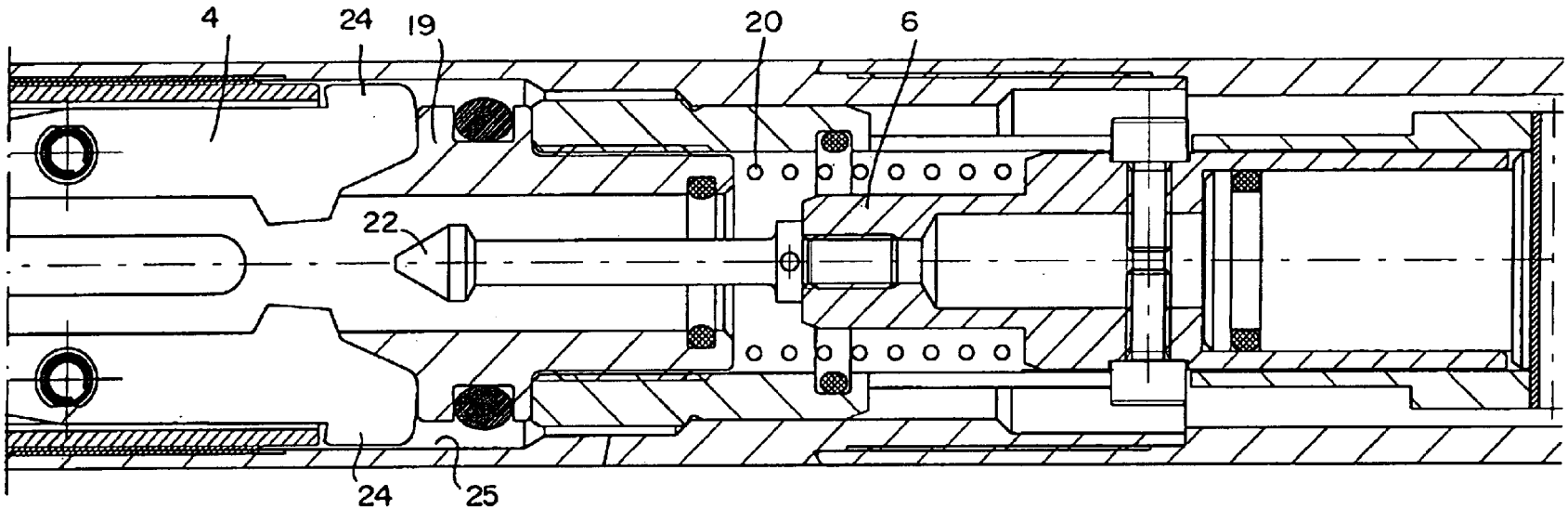
Figure 6:
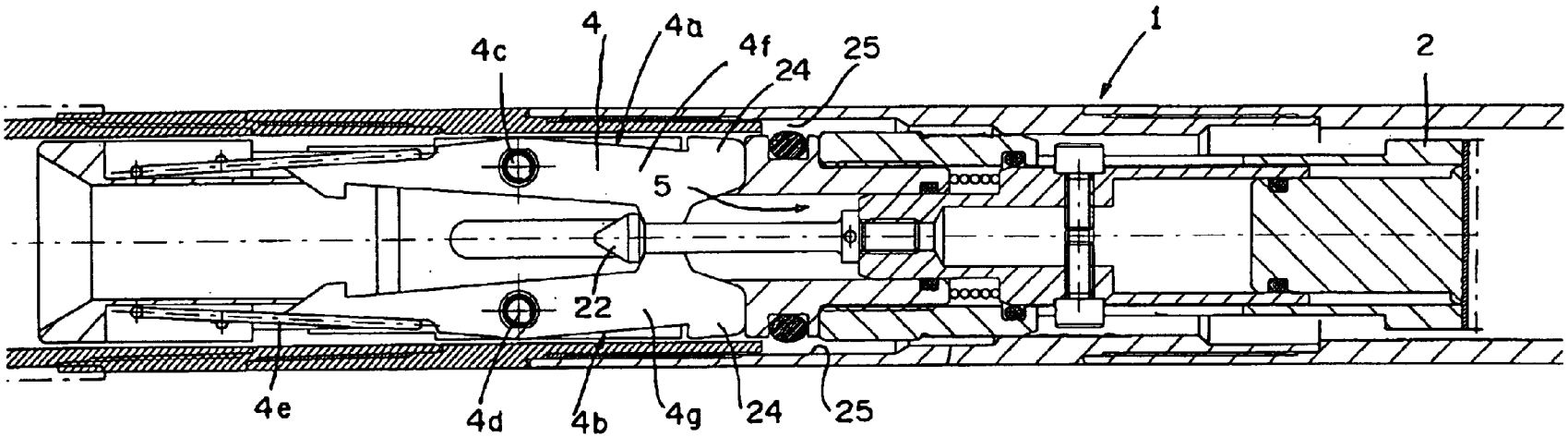

The invention will now be described in detail with reference to the accompanying drawings, illustrating a non-limiting embodiment of the invention by way of example, in which:

FIG. 1 shows a longitudinal section through a valve, in accordance with the present invention, in closed position, when used in a drill string, FIG. 2 shows a longitudinal section through a valve, in accordance with the present invention, in open position, when used in a drill string, FIG. 3 shows a partial enlargement of the valve in FIG. 1, in closed position, FIG. 4 shows a partial enlargement of the valve in FIG. 1, still in closed position, FIG. 5 shows a partial enlargement of the valve in FIG. 2, in open position, and FIG. 6 shows the locking device, gripping means, valve and inner tube before the inner tube arrives at the position where drilling can start.

The embodiment illustrated by way of example shows an application wherein a valve in accordance with the present invention is used with a system for wire line core drilling.

The drill string in FIG. 1 thus comprises an outer tube 1 connected to a drill bit, and an inner tube 2, by means of which core samples are collected. Drilling is performed towards the right in the drawing, this being designated the forward direction. A valve 5 for flushing medium is arranged in the rear part of the inner tube. The flushing medium is generally water. When a new inner tube for core samples is to be installed in an existing outer tube for drilling substantially in horizontal direction or at various upward angles, the inner tube is pumped along inside the drill string with the aid of flushing medium, preferably water. FIG. 1 illustrates the position when the inner tube has just reached the correct position for drilling but has not yet been locked in relation to the outer tube.

A locking device 4 is also arranged in the rear part of the inner tube. As in the example illustrated, this may preferably consist of a locking device such as is the subject of the applicant's own Swedish patent application filed simultaneously with the present patent application. This locking device not only locks the valve in closed position mechanically, but also firmly retains the inner tube in relation to the outer tube when the inner tube has assumed the correct position for drilling. This occurs by the forward, outwardly directed protrusions 24 of the locking device rebounding and engaging with corresponding recesses 25 on the inside of the outer tube, as illustrated in FIGS. 4 and 5. In other applications it is naturally feasible to use a locking device that only retains the valve mechanically.

The valve 5 comprises a valve body 6 movable between a closed position as shown in FIG. 1 and an open position as shown in FIG. 2. For a clearer picture of the valve, reference is made in the following primarily to FIGS. 3 to 5, showing enlarged-views of the valve. The valve 6 is provided with a communication or a connection 8 connecting the first, rear side 9 of the valve body, comprising a surface 10 facing the direction in which the pressurised fluid is supplied, with a second, forward side 11 consisting of two surfaces 12, 14. The connection 8 may alternatively be described as connecting a space 15 behind the valve body or piston 6 with a space in front of the valve body which, in the example illustrated, is a space 16 situated inside the valve body.

In the embodiment illustrated by way of example the valve body 6 is joined to a gripping means 22 which, in co-operation with the previously mentioned locking device 4, mechanically maintains the valve body in its closed position. This is achieved by the locking device having inwardly directed protrusions 23 that grip around the gripping means 22. The gripping means 22 is secured in the valve body by its forward end 27 being screwed into an axial hole 28, provided with threading, in the rear end of the valve body. Said hole is open to the space 16 inside the valve body. To achieve said connection 8 between the space 16 and the space 15 behind the valve body, therefore, the forward part 27 of the gripping means 22 is provided with an axial boring or a hole, open to the space 16, and a radial hole connected thereto and to the space 15. In the present embodiment, therefore, the connection 8 comprises two parts—an axial hole and a radial hole. It is naturally perfectly feasible to secure the gripping means in the valve body by means of some other arrangement, and the appearance and positions of the holes may be modified without departing from the inventive concept as regards the connection 8. It should particularly be mentioned that it is possible to arrange the connection 8 directly as a hole through the valve body.

The valve body has a rear part 17 with smaller diameter and a forward part 18 with larger diameter. The rear part 17 slides in a housing 19 whereas the forward part 18 preferably slides directly inside the inner tube 2. A spring 20 is arranged between the housing 19 and the forward part 18. In the example illustrated this is a helical spring. It is compressed when the valve is closed and its spring force thus acts to open the valve.

When the valve is in its closed position, as shown in FIGS. 1, 3 and 4, and a pressurised fluid in the form of a flushing medium is supplied to the valve in the direction from the left in the drawings, this pressurised fluid will exert a force $F_1$ on the surface 10 consisting of the rear side 9 of the valve body. Since the fluid will also penetrate through the valve body via the connection 8, see particularly FIG. 4, the valve body will also be influenced by forces from the fluid in a direction opposite to the supply direction when the fluid pressure acts on the surfaces 12 and 14 on the other side 11 of the valve. At the same time the valve body is influenced by the spring force $F_f$. To ensure that the valve remains in closed position even after the locking device has released the valve body, as shown in FIG. 4, the follow correlation must prevail:

$$F_1+F_f<F_2+F_3$$

where $F_1=p\cdot A_1$, $F_2=p\cdot A_2$, $F_3=p\cdot A_3$, wherein p is the pressure of the supplied fluid and $A_1$, $A_2$, $A_3$ are the areas of the surfaces 10 on the rear side 9 and 12 and 14 on the front side 11, respectively, of the valve body.

It should be mentioned that, for the above correlation to prevail in practice, O-rings 13 are arranged as seals preventing the space containing the spring 20 from being pressurised. An O-ring is thus arranged between the outside of the forward part 18 of the valve body and the inside of the inner tube 2, and an O-ring is arranged between the outside of the rear part 17 of the valve body and the inside of the housing 19.

For the valve to open, the supply of pressurised fluid must be cut off and the fluid placed in communication with atmospheric pressure in order to achieve pressure equalisation between both sides of the valve body. It will then only be influenced by the spring force, causing the spring 20 to expand so that the valve body 6 is moved out of the housing 19 and the valve is thus open, as illustrated in FIG. 2 and FIG. 5.

In the illustrated use of the valve the inner tube is pumped into the outer tube with a typical pressure of 30 to 40 bar. When the inner tube has reached its correct position in the outer tube, it is firmly locked there, as shown in FIG. 3, i.e. it touches bottom, the pressure increases to in the order of 50 bar or the maximum pressure for the pump. The pressure is then shut off and the fluid is placed in communication with atmospheric pressure so that the valve opens, as illustrated in FIG. 5. Thereafter the supply of pressurised fluid is turned on again, at a pressure in the order of 10–20 bar, and this is then the pressure used during drilling.

The present invention is naturally not limited to the embodiment and the application illustrated. It may be varied in many feasible ways within the scope of the invention as described in the specification and the appended claims. The valve may thus be used entirely independently and in entirely different contexts, with or without any form of locking device that produces mechanical locking. Furthermore, the method may also be used in other contexts and other applications where similar problems need solving and delayed opening of a valve is desired.

What is claimed is:

1. A method for a valve, which valve comprises a movable valve body having a first side facing a means for supplying pressurized fluid and influenced in the supply direction by a force from said fluid, and a second side influenced in opposite direction by a force from said fluid, which valve is provided with at least one fluid connection connecting the first side of the valve body with the second side of the valve body and thereby allowing said supplied pressurized fluid to flow from said first side to said second side of the valve body, and also comprising a spring for opening the valve by displacing the valve body from a closed position to an open position, said method comprising the following steps:

a pressurized fluid is supplied to the valve in closed position whereupon the valve remains closed, the supply of pressurized fluid to the closed valve ceases, a force equalization then occurs between said first and second sides in that fluid flows through the fluid connection, thereby enabling the spring to open the valve, and a pressurized fluid is supplied to the valve in open position and the valve remains open.

2. A method for a valve, which valve comprises a movable valve body having a first side facing a means for supplying pressurized fluid and influenced in the supply direction by a force from said fluid, and a second side influenced in opposite direction by a force from said fluid, which valve is provided with at least one connection connecting the first side of the valve body with the second side of the valve body, and also comprising a spring for opening the valve by displacing the valve body from a closed position to an open position, said method comprising the following steps:

a pressurized fluid is supplied to the valve in closed position whereupon the valve remains closed, the supply of pressurized fluid to the closed valve ceases, a force equalization then occurs between said first and second sides in that fluid flows through the connection, thereby enabling the spring to open the valve, and a pressurized fluid is supplied to the valve in open position and the valve remains open, the valve further being provided with a locking device to mechanically lock said valve when in closed position, which method comprises the following steps:

the pressurized fluid is supplied to the valve in closed and mechanically locked position, the locking device is caused to cease locking said valve in closed position, the valve continues to be closed even when the locking device no longer locks the valve, since the pressurized fluid supplied still causes the valve to remain closed, the supply of pressurized fluid ceases, and a force equalization then occurs between said first and second sides, thereby enabling the spring to open the valve.

3. A method as claimed in claim 2 wherein the method is used with a valve for a wire line core drill comprising an inner tube by means of which core samples are collected, and an outer tube connected to a drill bit, in that the locking device is applied in the rear end of the inner tube, in that said valve is placed at the rear end of the inner tube and controls the supply of a flushing medium in the form of a pressurized fluid and wherein, when the inner tube has been inserted in the outer tube and has assumed the correct position inside the outer tube for drilling, in one and the same movement said locking device simultaneously achieves locking of the inner tube in relation to the outer tube and releases said valve so that it is no longer mechanically locked.

4. A method as claimed in claim 3 wherein, after the pressurized fluid is supplied to the valve in closed and mechanically locked position, the locking device is caused to cease locking said valve in closed position, the valve continues to be closed, the supply of pressurized fluid ceases, and a force equalization occurs between said first and second sides, thereby enabling the spring to open the valve, a signal is conveyed to a drill rig, said signal indicating that the inner tube has assumed the correct position inside the outer tube and that drilling can be commenced.

5. A valve comprising a movable valve body having a first side facing a means for supplying pressurized fluid and having at least one first surface that is influenced in the supply direction by a force F1 from said fluid, and a second side facing in the opposite direction, and which valve is provided with at least one fluid connection connecting the first side of the valve body with the second side of the valve body and thereby allowing said supplied pressurized fluid to flow from said first side to said second side of the valve body, wherein the valve comprises a spring for opening the valve by displacing the valve body from a closed position to an open position, in that said second side of the valve body has at least one second surface that is influenced by a force from said fluid in a direction opposite to the supply direction, and in that the area of said second surface is greater than that of said first surface so that the force influencing the valve body in closing direction, in the form of the force from the pressurized fluid acting on said second surface exceeds the force influencing the valve body in opening direction, in the form of the combined force Ff from the spring and the force F1 from the pressurized fluid acting on said first surface, whereby the valve body is retained in the closed position of the valve when pressurized fluid is supplied.

6. A valve as claimed in claim 5 wherein the valve is so designed that, when the supply of pressurized fluid to the closed valve ceases, a force equalization occurs via said fluid connection between said first and second sides, and in that the spring then influences the valve body so that it is displaced from its closed to its open position.

7. A valve as claimed in claim 6 wherein the second surface, on the second side of the valve body is divided into two surfaces.

8. A wire line core drill system comprising a wire line core drill having an inner tube by means of which core samples are collected, an outer tube connected to a drill bit, and a valve situated at the rear end of the inner tube, said valve controlling the supply of a flushing medium in the form of a pressurized fluid, wherein the valve is constructed in accordance with claim 7.

9. A wire line core drill system comprising a wire line core drill having an inner tube by means of which core samples are collected, an outer tube connected to a drill bit, and a valve situated at the rear end of the inner tube, said valve controlling the supply of a flushing medium in the form of a pressurized fluid, wherein the valve is constructed in accordance with claim 6.

10. A valve as claimed in claim 5 wherein the second surface, on the second side of the valve body, is divided into two surfaces.

11. A wire line core drill system comprising a wire line core drill having an inner tube by means of which core samples are collected, an outer tube connected to a drill bit, and a valve situated at the rear end of the inner tube, said valve controlling the supply of a flushing medium in the form of a pressurized fluid, wherein the valve is constructed in accordance with claim 10.

12. A wire line core drill system comprising a wire line core drill having an inner tube by means of which core samples are collected, an outer tube connected to a drill bit, and a valve situated at the rear end of the inner tube, said valve controlling the supply of a flushing medium in the form of a pressurized fluid, wherein the valve is constructed in accordance with claim 5.

13. A system as claimed in claim 12 including means for transmitting a signal to a drill rig, said signal indicating that the inner tube has assumed the correct position inside the outer tube and that the valve has been opened.

14. A valve comprising a movable valve body having a first side facing a means for supplying pressurized fluid and having at least one first surface that is influenced in the supply direction by a force F1 from said fluid, and a second side facing in the opposite direction, and which valve is provided with at least one connection connecting the first side of the valve body with the second side of the valve body, wherein the valve comprises a spring for opening the valve by displacing the valve body from a closed position to an open position, in that said second side of the valve body has at least one second surface that is influenced by a force from said fluid in a direction opposite to the supply direction, and in that the area of said second surface is greater than that of said first surface so that the force influencing the valve body in closing direction, in the form of the force from the pressurized fluid acting on said second surface exceeds the force influencing the valve body in opening direction, in the form of the combined force Ff from the spring and the force F1 from the pressurized fluid acting on said first surface, whereby the valve body is retained in the closed position of the valve when pressurized fluid is supplied, the valve being provided with a locking device for mechanically locking said valve when it is in closed position.

15. A wire line core drill system comprising a wire line core drill having an inner tube by means of which core samples are collected, an outer tube connected to a drill bit, and a valve situated at the rear end of the inner tube, said valve controlling the supply of a flushing medium in the form of a pressurized fluid, wherein the valve is constructed in accordance with claim 14.

16. A wire line core drill system comprising a wire line core drill having an inner tube by means of which core samples are collected, an outer tube connected to a drill bit, and a valve situated at the rear end of the inner tube, said valve controlling the supply of a flushing medium in the form of a pressurized fluid, the valve comprising a movable valve body having a first side facing a means for supplying pressurized fluid and having at least one first surface that is influenced in the supply direction by a force F1 from said fluid, and a second side facing in the opposite direction, and which valve is provided with at least one connection connecting the first side of the valve body with the second side of the valve body, wherein the valve comprises a spring for opening the valve by displacing the valve body from a closed position to an open position, in that said second side of the valve body has at least one second surface that is influenced by a force from said fluid in a direction opposite to the supply direction, and in that the area of said second surface is greater than that of said first surface so that the force influencing the valve body in closing direction, in the form of the force from the pressurized fluid acting on said second surface exceeds the force influencing the valve body in opening direction, in the form of the combined force Ff from the spring and the force F1 from the pressurized fluid acting on said first surface, whereby the valve body is retained in the closed position of the valve when pressurized fluid is supplied, the valve being provided with a locking device for mechanically locking said valve when it is in closed position, wherein the valve provided with the locking device is applied in the rear end of the inner tube and in that said locking device is so constructed that, when the inner tube has been inserted in the outer tube and has assumed the correct position inside the outer tube for drilling, in one and the same movement it simultaneously achieves locking of the inner tube in relation to the outer tube and releases said valve so that it is no longer mechanically locked.

17. A valve comprising a movable valve body having a first side facing a means for supplying pressurized fluid and having at least one first surface that is influenced in the supply direction by a force F1 from said fluid, and a second side facing in the opposite direction, and which valve is provided with at least one connection connecting the first side of the valve body with the second side of the valve body, wherein the valve comprises a spring for opening the valve by displacing the valve body from a closed position to an open position, in that said second side of the valve body has at least one second surface that is influenced by a force from said fluid in a direction opposite to the supply direction, and in that the area of said second surface is greater than that of said first surface so that the force influencing the valve body in closing direction, in the form of the force from the pressurized fluid acting on said second surface exceeds the force influencing the valve body in opening direction, in the form of the combined force Ff from the spring and the force F1 from the pressurized fluid acting on said first surface, whereby the valve body is retained in the closed position of the valve when pressurized fluid is supplied, the valve being so designed that, when the supply of pressurized fluid to the closed valve ceases, a force equalization occurs via said connection between said first and second sides, and in that the spring then influences the valve body so that it is displaced from its closed to its open position, the valve being provided with a locking device for mechanically locking said valve when it is in closed position.

18. A wire line core drill system comprising a wire line core drill having an inner tube by means of which core samples are collected, an outer tube connected to a drill bit, and a valve situated at the rear end of the inner tube, said valve controlling the supply of a flushing medium in the form of a pressurized fluid, wherein the valve is constructed in accordance with claim 17.

19. A valve comprising a movable valve body having a first side facing a means for supplying pressurized fluid and having at least one first surface that is influenced in the supply direction by a force F1 from said fluid, and a second side facing in the opposite direction, and which valve is provided with at least one connection connecting the first side of the valve body with the second side of the valve body, wherein the valve comprises a spring for opening the valve by displacing the valve body from a closed position to an open position, in that said second side of the valve body has at least one second surface that is influenced by a force from said fluid in a direction opposite to the supply direction, and in that the area of said second surface is greater than that of said first surface so that the force influencing the valve body in closing direction, in the form of the force from the pressurized fluid acting on said second surface exceeds the force influencing the valve body in opening direction, in the form of the combined force Ff from the spring and the force F1 from the pressurized fluid acting on said first surface, whereby the valve body is retained in the closed position of the valve when pressurized fluid is supplied, the second surface, on the second side of the valve body, being divided into two surfaces, the valve s being provided with a locking device for mechanically locking said valve when it is in closed position.

20. A wire line core drill system comprising a wire line core drill having an inner tube by means of which core samples are collected, an outer tube connected to a drill bit, and a valve situated at the rear end of the inner tube, said valve controlling the supply of a flushing medium in the form of a pressurized fluid, wherein the valve is constructed in accordance with claim 19.

21. A valve comprising a movable valve body having a first side facing a means for supplying pressurized fluid and having at least one first surface that is influenced in the supply direction by a force F1 from said fluid, and a second side facing in the opposite direction, and which valve is provided with at least one connection connecting the first side of the valve body with the second side of the valve body, wherein the valve comprises a spring for opening the valve by displacing the valve body from a closed position to an open position, in that said second side of the valve body has at least one second surface that is influenced by a force from said fluid in a direction opposite to the supply direction, and in that the area of said second surface is greater than that of said first surface so that the force influencing the valve body in closing direction, in the form of the force from the pressurized fluid acting on said second surface exceeds the force influencing the valve body in opening direction, in the form of the combined force Ff from the spring and the force F1 from the pressurized fluid acting on said first surface, whereby the valve body is retained in the closed position of the valve when pressurized fluid is supplied, the valve being so designed that, when the supply of pressurized fluid to the closed valve ceases, a force equalization occurs via said connection between said first and second sides, and in that the spring then influences the valve body so that it is displaced from its closed to its open position, the second surface, on the second side of the valve body being divided into two surfaces, the valve being provided with a locking device for mechanically locking said valve when it is in closed position.

22. A wire line core drill system comprising a wire line core drill having an inner tube by means of which core samples are collected, an outer tube connected to a drill bit, and a valve situated at the rear end of the inner tube, said valve controlling the supply of a flushing medium in the form of a pressurized fluid, wherein the valve is constructed in accordance with claim 21.

* * * * *